United States Patent [19]

Wade

[11] Patent Number: 4,861,243

[45] Date of Patent: Aug. 29, 1989

[54] DIESEL FUEL INJECTION PUMP WITH VARIABLE INJECTION TIMING

[75] Inventor: Wallace R. Wade, Farmington Hills, Mich.

[73] Assignee: Ford Motor Company, Dearborn, Mich.

[21] Appl. No.: 179,446

[22] Filed: Apr. 8, 1988

[51] Int. Cl.[4] ..... F02M 59/20

[52] U.S. Cl. ..... 417/499

[58] Field of Search ..... 417/490, 494, 499; 123/500, 501, 502, 503, 504

[56] References Cited

U.S. PATENT DOCUMENTS

| | | | |
|---|---|---|---|
| 2,863,438 | 12/1958 | Challis | 123/502 |
| 3,782,864 | 1/1974 | Perr | 417/493 |
| 3,847,510 | 11/1974 | Fenne | 417/293 |
| 3,859,973 | 1/1975 | Dreisin | 123/502 |
| 4,494,514 | 1/1985 | Augustin | 123/502 X |
| 4,712,985 | 12/1987 | Wakasa et al. | 417/499 X |

*Primary Examiner*—Leonard E. Smith

*Attorney, Agent, or Firm*—Clifford L. Sadler; Jerome R. Drouillard

[57] ABSTRACT

A plunger-type injection pump for use in automotive installations is provided not only with plunger rotating means to vary the quantity of fuel injected but also with a novel tappet assembly that includes hydraulically actuated facing nested parts that can be axially separated as well as angularly rotated relative one to the other to vary the height of the plunger from an initial setting in a continuously variable manner to thereby continuously vary the injection timing.

2 Claims, 1 Drawing Sheet

DIESEL FUEL INJECTION PUMP WITH VARIABLE INJECTION TIMING

This invention relates in general to a fuel injection pump for automotive installation. More particularly, it relates to one in which the injection timing, as well as the volume of fuel injected, can be varied.

It is the primary object of the invention to provide a simple and economical way to vary the injection timing of a plunger type fuel injection pump for automotive installations.

Optimum emissions and fuel consumption for a diesel engine will be obtained at a specific injection timing for each engine speed and load condition over the operating range of the engine. To achieve these objectives, injection timing must be scheduled as a function of engine speed and load.

The injection timing cannot be easily varied on conventional in-line fuel injection pumps used on midrange and heavy duty diesel engines. Usually, a centrifugally actuated phase shifter is placed on the drive shaft of the pump to vary the timing of the camshaft in the pump relative to the engine crankshaft. Recently, hydraulically activated phase shifters have been proposed in which electronic or mechanical controls are used to vary the supply pressure to the phase shifter in order to provide control of injection timing. One of the disadvantages of this system is the high external pressure requirements.

Examples of this type of construction are U.S. 4,712,985, Wakasa et al, U.S. 3,847,510, Fenne, and U.S. 3,782,864, Perr. All show similar constructions in the use of a hydraulically actuated piston relatively movable with respect to a portion of the plunger to vary the height or lift of the plunger for its pumping stroke. In all cases, the lift is varied by varying the supply pressure to the unit.

The invention provides a new technique for varying the injection timing of an in-line fuel injection pump. In this case, the tappet is similar to a conventional hydraulic tappet. However, it is modified to include an inverted cup shaped top section that faces and nests or fits within a cup shaped bottom section. Oil pressure is supplied to the inside cavity of the tappet through a hole in the bottom section and through a helical slot and connecting passage in the top section. Provision is made for rotating the top section so that the alignment of the helix with the oil inlet/outlet hole can be varied to thereby vary the height of the tappet from its initial set position.

It is another object of the invention, therefore, to provide an automotive type fuel injection pump not only with means to vary the injection quantity but also means to vary the injection timing without dependence upon a varying supply pressure.

A further object of the invention is to provide an automotive type fuel injection pump that is simple to construct and assemble, and economical to manufacture; and yet provides a means to change the injection timing in a variable manner by changing the height of the tappet portion of the plunger by rotating the tappet as well as axially collapsing the tappet.

Figure 1:
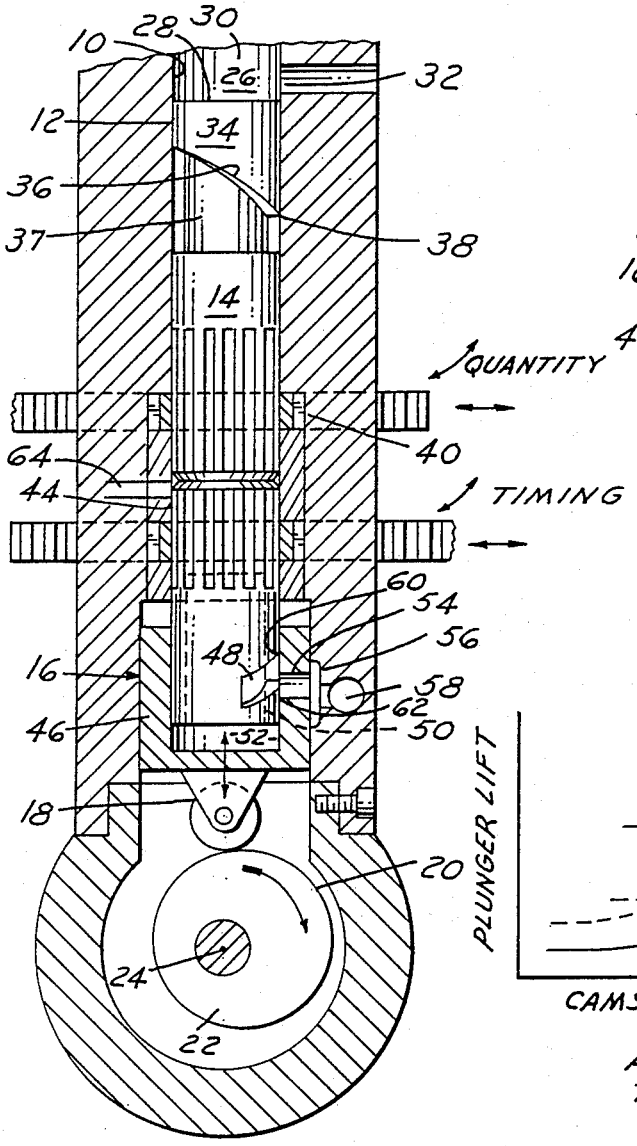
Figure 2:
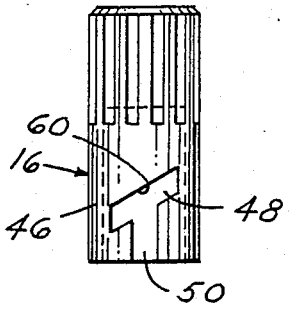

Other objects, features and advantages of the invention will become more apparent upon reference to the succeeding, detailed description thereof, and to the drawings illustrating a preferred embodiment thereof; wherein, FIG. 1 illustrates schematically a portion of a fuel injection pump embodying the invention;

FIG. 2 is a view of a detail of FIG. 1 rotated to another position; and

Figure 3:
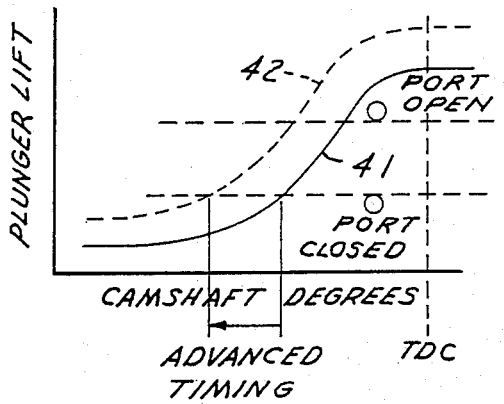

FIG. 3 graphically illustrates the change in plunger lift versus engine camshaft degree of rotation of a fuel injection pump embodying the invention.

FIG. 1 shows a fuel injection pump of the plunger type that would be installed in a suitable housing, not shown. It has at least one radial bore 10 defined by the stationary barrel 12 of a fuel injection assembly. Slidably mounted for reciprocation within the barrel is a plunger 14 having a tappet assembly 16 at its lower end constructed according to the invention. A roller assembly 18 is secured to the lower end of the tappet assembly for engagement with a cam 20. The latter is fixed for rotation on an engine camshaft 22 rotatable about an axis 24, as shown. The camshaft would be directly driven by the engine at one-half of the engine speed.

The upper end of barrel 10 constitutes a pressurization chamber 26 between the top face 28 of the plunger and a reduced bore opening 30 in the plunger barrel. The latter would lead to a conventional delivery valve or similarly constructed device controlling injection of the fuel into the engine cylinder in a known manner. A fuel fill/spill port 32 is provided in the wall of barrel 10 for cooperation with the top portion or land 34 of the plunger. So long as the plunger does not cover the fill/spill port, fuel in chamber 26 can drain or vent through the port 32 and no fuel will be injected into the engine. As soon as the plunger 14 moves upwardly to close port 32, the fuel in chamber 26 then will become pressurized and upon attaining a predetermined pressure level will be injected into the engine in the conventional manner.

As shown, the plunger has a helical portion or surface 36 defining a radial recess 37 that extends circumferentially around a portion of the plunger. The recess is aligned or misaligned with the fill/spill port to predetermine the quantity of fuel to be injected during each pumping stroke. More particularly, in the position shown, once the top edge or face 28 of the plunger covers the upper edge of the fill port 32, fuel will be pressurized and continue to be injected until the lower right edge portion 38 of the plunger uncovers the port 32.

In order to vary the quantity of fuel injected, means are provided for rotating or angularly positioning the helix of the plunger. This can be accomplished by any known type of rack and pinion type rotator, such as that indicated in general by the assembly 40. The rack in this case is moved laterally by any suitable electrical or mechanical means, for example, to angularly or circumferentially rotate the plunger 14. This will vary the position of the helix 36 relative to the port 32 so that during the upward stroke of the plunger, the port 32 can be opened or closed more quickly than before.

The above construction is known and conventional. If a solid tappet were used in this pump, the start and end of injection would occur as indicated by the solid curve 41 in FIG. 3 in which plunger lift is plotted against engine camshaft degree rotation. The start of injection timing would always start at a fixed timing and the end of injection would be determined by the quantity of injected fuel. This, in turn, would be determined by the angular orientation of the plunger as described above, which would determine the duration that the fill/spill port would be closed.

As stated previously, the injection timing can be changed by changing the height of the tappet, as is illustrated by the dotted line curve 42 in FIG. 3. The means for changing the height of the tappet is illustrated in FIG. 1. The tappet is similar to a hydraulic tappet, but in this case consists of a pair of upper and lower cup shaped nested elements 44 and 46 that face one another but are adapted to be separated axially and rotated one relative to the other angularly. This will provide a variable height to the tappet to variably change the injection timing.

More particularly, the lower element 46 to which the roller assembly 18 is secured is essentially of a cup-shape. It slidably receives therein an inverted cup-shaped upper element 44 having a helical slot 48 in its outer peripheral portion. The slot extends around the periphery for approximately 90°, and it intersected by a vertical slot or passage 50 shown more clearly in FIG. 2. The latter communicates the fluid in the helical slot to the hollow chamber 52 defined between the nested elements 44 and 46. The helix 48 is adapted to align or misalign with a fill/vent port or passage 54 through the wall of the lower element 46. The port 54 on the other hand is connected at all times with an oversized port 56 that is supplied at all times with oil from an oil pressure supply passage 58. The source of the oil could be the engine lubricating system.

The upper element 44 does not move relative to the lower element. The lower element 46 can move vertically relative to the upper element in response to egress from or influx of oil into the chamber 52 defined between the two elements. In operation, as the cam 20 begins to move the bottom part 46 of the tappet vertically, oil previously admitted through the port 54, helix 48, and passage 50 to the chamber 56 will be displaced from inside the cavity of the tappet. As the bottom part 46 continues to move up relative to the upper portion or element 44, there will be a lost motion between the two as the oil is displaced out of the cavity and through the open port 54 back to the supply line 58. The helix 48 eventually will be closed off by its upper edge or portion 60 being passed by the lower edge 62 of the port 54. At this point, the oil will become trapped inside the tappet chamber 52 so that the top and bottom elements 44 and 46 will now move upwardly as one unit or piece.

The numeral 64 indicates schematically a rack and pinion type assembly that can be fixed to the upper element 44 for rotating the same in a manner similar to rotation of plunger 14 by the rack and pinion assembly 40. Other known or conventional types of rotators could be substituted therefor without departing from the scope of the invention. The details of construction and operation of the rotator will not be given in detail. Suffice it to say, however, that a continuously variable range of injection timings can be obtained by rotating the top element or part 44 of the tappet to vary the vertical position of the helix 48 for alignment with the port 54 at the downwardmost position of the plunger stroke to thereby vary the time in which the helical portion 36 on the plunger will mate with the fill/spill port 32; that is, the point at which oil hole 54 is closed off, thereby trapping the oil inside the tappet, will occur at different heights.

The operation is believed to be clear from a consideration of the above description and drawings, and therefore, will not be repeated. From the foregoing, it will be clear that the invention provides a simple and yet efficient construction to adapt a plunger-type injection pump for a continuously variable injection timing by the use of a simple device with a fewness of parts and one that is economical to manufacture.

While the invention has been shown and described in its preferred embodiment, it will be clear to those skilled in the arts to which it pertains that many changes and modifications may be made thereto without departing from the scope of the invention.

I claim:

1. A fuel injection pump of the spill port type having an engine camshaft cam driven plunger reciprocably movable in a plunger barrel through pumping and return strokes past a fuel fill/spill port in the wall of the barrel, the plunger having a fuel metering helix thereon movable axially with the plunger from positions of non-alignment and alignment with the spill port to provide a set opening and closing duration of the spill port to thereby provide a set quantity of fuel to be injected for each axial lift of the plunger, and thereby a set fuel injection timing, and adjustable lost motion means between the cam and plunger for varying the initial axial position of the metering helix from a set position at the end of the return stroke to vary the timing of injection, the lost motion means including a pair of nested cup-shaped members facing one another wherein at least one member is movable axially relative to the other to change the distance between the cam and plunger, the nested members defining a closed fluid chamber between, each of the nested members having a fill/spill-like port/passage, the latter being alignable in one relative position of the nested members to supply a fluid under pressure to said chamber or vent the fluid therefrom to effect a movement of the one member without movement of the other, and being misalignable in another relative position of the nested members to block entry or exit of the fluid to or from the chamber to effect a unitary movement of the members thereafter, and means to rotate one of the members to vary the duration of alignment of one of the ports relative to the other to thereby vary the axial position of the metering helix.

2. A fuel injection pump of the spill port type having an engine camshaft cam driven plunger reciprocably movable in a plunger barrel through pumping and return strokes past a fuel fill/spill port in the wall of the barrel, the plunger having a fuel metering helix thereon movable axially with the plunger from positions of non-alignment and alignment with the spill port to provide a set opening and closing duration of the spill port to thereby provide a set quantity of fuel to be injected for each axial lift of the plunger, and thereby a set fuel injection timing, and adjustable lost motion means between the cam and plunger for varying the initial axial position of the metering helix from a set position at the end of the return stroke to vary the timing of injection, the lost motion means including a hydraulically operated tappet-like member including upper and lower cup-shaped elements facing one another and defining a fluid chamber between, the upper element being slidably nested within the lower element and having a helically shaped fluid fill/spill slot/groove in its wall, the lower element having a second port through its wall alignable at times with the helical port so that fluid under pressure may be communicated to from the chamber to permit movement of the lower element by the cam relative to the upper element until the fluid port and slot become misaligned, and means for rotating the upper element to vary the initial relative vertical positions of the slot and port to vary the duration of misalignment of the fluid slot and port to thereby vary the position of the metering helix at the start of the pumping stroke of the plunger.

* * * * *